US006882796B2

(12) United States Patent
Ito et al.

(10) Patent No.: US 6,882,796 B2
(45) Date of Patent: Apr. 19, 2005

(54) HYBRID HOT AIR HEATER

(75) Inventors: Keiichi Ito, Aichi-Ken (JP); Yoshinori Fujisawa, Aichi-Ken (JP); Yukihiko Shimonoma, Aichi-Ken (JP); Yoshimune Yamada, Aichi-Ken (JP)

(73) Assignee: Rinnai Corporation, Aichi-Ken (JP)

( * ) Notice: Subject to any disclaimer, the term of this patent is extended or adjusted under 35 U.S.C. 154(b) by 13 days.

(21) Appl. No.: 10/676,029

(22) Filed: Oct. 2, 2003

(65) Prior Publication Data

US 2005/0036770 A1 Feb. 17, 2005

(30) Foreign Application Priority Data

Oct. 2, 2002 (JP) ..... 2002-289588

(51) Int. Cl.[7] ..... F24D 13/00
(52) U.S. Cl. ..... 392/307; 392/365
(58) Field of Search ..... 392/307, 360–369, 392/347; 219/476

(56) References Cited

U.S. PATENT DOCUMENTS 2,060,079 A * 11/1936 Hood ..... 126/92 AC
3,295,334 A * 1/1967 Lennart ..... 62/148
5,937,139 A * 8/1999 Peterson ..... 392/307
6,795,643 B1 * 9/2004 Ito et al. ..... 392/307
2004/0103892 A1 * 6/2004 Shimonoma et al. ..... 126/110
2004/0109680 A1 * 6/2004 Ito et al. ..... 392/307
2004/0151480 A1 * 8/2004 Ito et al. ..... 392/307

FOREIGN PATENT DOCUMENTS

FR 2610089 * 7/1988
FR 2687899 * 9/1993
JP 55-63348 * 5/1980

* cited by examiner

*Primary Examiner*—John A. Jeffery
(74) *Attorney, Agent, or Firm*—Arent Fox

(57) ABSTRACT

In a configuration of a hybrid hot air heater in which a gas heater unit 2 and an electric heater unit 3 are incorporated into one chassis at the upper part and lower part, respectively, in such a manner that their respective air-blowing systems may be independent of each other, the heater itself is made more compact even with increases in the cross-sectional area of inlets 13*a* and 13*b* equipped with anti-dust filters 6*a* and 6*b*, respectively. The second inlet 13*b* of the electric heater unit 3 provided on the chassis 11 is arranged below a gas burner 20 in such a manner as to conserver space and serves as an air inlet passage on the rear side of a housing 211 of a first air-blowing fan 21 that separates the gas heater unit 2 and the electric heater unit 3 from each other.

3 Claims, 2 Drawing Sheets

HYBRID HOT AIR HEATER

BACKGROUND OF THE INVENTION

1. Field of the Invention

The present invention relates to a hybrid hot air heater incorporating a gas heater and an electric heater into one chassis.

2. Description of the Related Art

This type of conventional hybrid hot air heater as disclosed in, for example, Jpn. Pat. Appln. KOKAI Publication. No. 2000-9347 is already known. In this conventional hybrid hot-air heater, a combustion heater and an electric heater are incorporated into a chassis such that an air-blowing system is constituted by one air-blowing fan. If, in this configuration, the air-blowing system for the combustion heater and that for the electric heater are controlled by one air-blowing fan, the generated heat quantity will be different compared to when the electric heater is operated together with the combustion heater and when the combustion heater is operated alone with the electric heater not operating. This makes it necessary for different quantities of intake air to be blown into the chassis in these different cases to prevent overheating thereby making it difficult to operate the combustion heater with stability because of differences in the quantity of combusted air.

To solve this problem, an approach that was considered is one in which the combustion heater unit and the electric heater unit are arranged one over the other and each provided with an air-blowing fan as well as an inlet and an outlet in such a configuration that their air-blowing systems may be independent of each other. The inlet is mounted with an anti-dust filter to prevent dust and dirt from accumulating into the chassis of the heater.

However, if an anti-dust filter is mounted to the inlet, the quantity of air sucked into the chassis when the air-blowing fan is driven will be decreased. Therefore, to blow out a sufficient quantity of hot air from the outlet through each of the air-blowing fans, it is necessary to increase the cross-sectional area of the inlet.

However, if an inlet having a larger cross-sectional area is formed on the rear face facing toward both of the combustion heater unit and the electric heater unit, the height of the heater itself will be increased making it more difficult to use thereby creating a problem.

In view of the above problems, it is an object of the present invention to provide a hybrid hot air heater such that the heater itself is compact and easy to use.

SUMMARY OF THE INVENTION

To solve the above problems, a hybrid hot air heater according to the present invention comprises a chassis having first and second outlets on its front face and first and second inlets on its rear face. These are configured such that a gas heater unit comprised of a gas burner and a first air-blowing fan arranged below the gas burner that mixes combustion gas sent from the gas burner and air taken into the chassis through the first inlet and blows it out through the first outlet to the room is incorporated into the chassis at its upper part. An electric heater unit comprised of an electric heater that heats air taken in through the second inlet and a second air-blowing fan that blows out the heated air through the second outlet into the room is incorporated into the chassis at its lower part in such a manner that air-blowing systems of the respective heater units may be independent of each other, wherein the second inlet is formed to conserve space and serve as an air inlet passage on a rear side of the housing of the first air-blowing fan that separates these heater units from each other.

According to the present invention, part of the chassis positioned on the rear side of the housing of the first air-blowing fan is used as an inlet for the electric heater unit in order that an increase in the cross-sectional area of this inlet does not increase the height of the heater itself.

It is to be noted that the first and second outlets may be formed adjacent to each other vertically such that air blown out from the first air-blowing fan and air blown out from the second air-blowing fan flow into each other.

However, if hot air is blown out from the second outlet in the electric heater unit arranged at the lower part, the hot air may overheat the floor of the room. Therefore, it is preferable for a fan duct leading to the second outlet formed in the housing of the second air-blowing fan to be arranged facing upward.

DESCRIPTION OF THE PREFERRED EMBODIMENTS

Figure 1:
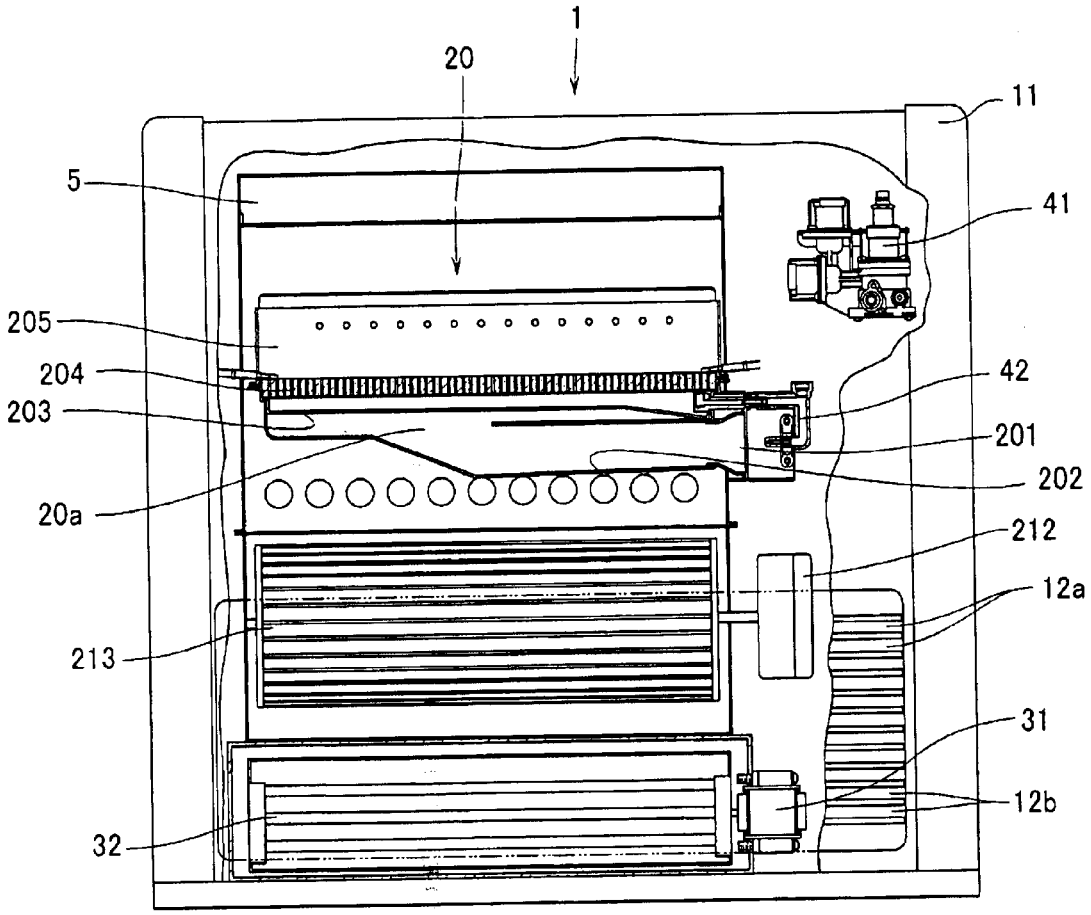
FIG. 1 is an explanatory front view of a configuration of a hybrid hot air heater according to the present invention and FIG. 2 is an explanatory vertical cross-sectional view of the configuration of the hybrid hot air heater according to the present invention.
Figure 2:
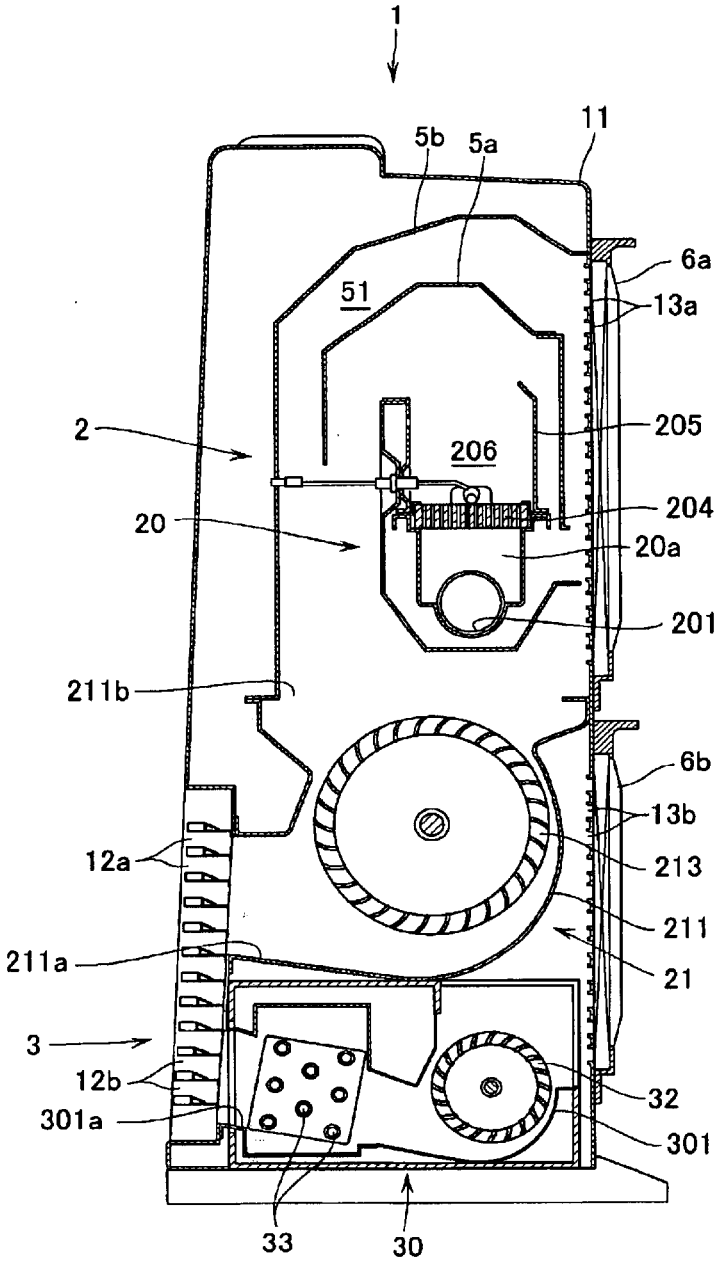

As shown in FIGS. 1 and 2, reference number 1 indicates a hybrid hot air heater according to the present invention. This hot air heater 1 has a box-shaped chassis 11. In the chassis 11, a gas heater unit 2 and an electric heater unit 3 are incorporated at the upper part and the lower part, respectively.

According to the present embodiment, a first outlet 12*a* and a second outlet 12*b* are formed on the front face of the chassis 11 and a first inlet 13*a* and a second inlet 13*b* are formed on the rear face of the chassis 11 in such a manner that they may stand against the gas heater unit 2 and the electric heater unit 3, respectively. Here, as described later, two air-blowing fans are used to make air-blowing systems for the respective gas heater unit 2 and electric heater unit 3 independent of each other.

The gas heater unit 2 comprises a gas burner 20 serving as a combustor and a first air-blowing fan 21 arranged below the gas burner 20 to supply it with combustion air. Fan 21 further mixes combusted gas and air that is sucked into the chassis 11 through the first inlet 13*a* and then blows out a mixture to the room.

The gas burner 20 is an all-primary combustion burner and has a burner body 20*a* including a fuel/air inlet 201 formed in the proximity of a gas spray nozzle 42 arranged at a tip of a gas tube (not shown) connected to a proportional valve 41 arranged in the chassis 11 and a mixer tube 202 that communicates with this inlet 201. A ceramic burner port plate 204 having a plurality of burner ports formed in it in a row is mounted to the opened upper face of the burner body 20*a* via a distribution plate 203 and is also covered above by a combustion cover 205.

In the chassis 11, a first partition 5*a* is provided in such a manner as to cover from above the combustion chamber 206 of the gas burner 20 covered by the combustion cover 205. Further, a second partition 5*b* is provided in the chassis 11 such that the gas burner 20 as well as the first partition 5*a* may be covered and an air passage 51 leading to the first air-blowing fan 4 may be formed between itself and the first partition 5*a*. The first air-blowing fan 21 arranged below the burner body 20*a* has a housing 211 in which a fan duct 211*a* leading to the first outlet 12*a* is formed.

A cross-flow type first moving vane 213 is arranged in the housing 211 and is connected to a first motor 212 whose rotation speed can be controlled. In this configuration, the air passage 51 and an internal space of the housing 211 communicate with each other through an upper face opening 211*b* formed in the housing 211.

Thus, the air-blowing system for the gas heater unit 2 is formed in such a manner leading from the first inlet 13*a* to the first outlet 12*a*. In this configuration, when the first motor 212 is driven to rotate the first moving vane 213, room air is taken into the chassis 11 through the inlet 13*a* and supplied to the inlet 201 in the burner body 20*a* as well as also through the air passage 51.

For this case, mixed air is supplied to the burner port plate 204 when combustion gas is sprayed into the inlet 201 through the gas spray nozzle 42. It is to be noted that the air/fuel ratio can be adjusted by controlling the first motor 212 to regulate the rotation speed of the first moving vane 213.

Combusted gas from the gas burner passes through the inside of the first partition 5*a* and is sucked toward the first air-blowing fan 21. Further the air taken in through the first inlet 13*a* flows to the end of the first partition 5*a* through the air passage 51 whereupon the combusted gas and the air are mixed and cooled and then flow into the housing 211 through an opening 211*b*. Then, a mixed gas having a predetermined temperature is released into the room through the outlet 12*a*.

The electric heater unit 3, on the other hand, has a second air-blowing fan 30 that communicates with the second inlet 13*b*. This second air-blowing fan 30 has a housing 301 in which a fan duct 301*a* leading to the outlet 12*b* is formed. A housing with a cross-flow type second rotation vane 32 connected to a second motor 31 whose rotation speed can be controlled is arranged here. Further, the fan duct 301*a* is provided with eight seed heaters 33.

Thus, an air-blowing system for the electric heater unit 3 is formed in such a manner leading from the second inlet 13*b* to the second outlet 12*b*. In this configuration, when the second motor 31 is driven to rotate the second moving vane 32, room air is taken in through the inlet 13*b*. This air is heated as it passes through the seed heater 33 provided on the fan duct 301*a* and is then released into the room through the outlet 12*b*.

It is to be noted that the outlets 12*a* and 12*b* are formed adjacent to each other such that hot air blown out by the first air-blowing fan 21 and hot air blown out by the second air-blowing fan 30 may flow into each other.

It is also to be noted that the first and second inlets 13*a* and 13*b* are mounted with anti-dust filters 6*a* and 6*b*, respectively, to prevent dust and dirt from accumulating in the chassis 11. These anti-dust filters 6*a* and 6*b* act as a hindrance to decreases in the quantity of air taken into the housings 211 and 301 when the first and second air-blowing fans 21 and 30 are driven, respectively.

Therefore, it is preferable to make the cross-sectional areas of each of the first and second inlets 13*a* and 13*b* larger in order to obtain a sufficient quantity of hot air blown out from each of the first and second outlets 12*a* and 12*b*. However, if an inlet having a large cross-sectional area is formed on the rear face of the chassis 11 facing the gas heater unit 2 and the electric heater unit 3, the height of the heater itself will increase.

In the present embodiment, the second inlet 13*b* is formed to conserve space. This inlet serves as an air inlet passsage on a rear side of the housing 211 of the first air-blowing fan 21 that separates the air-blowing system of the gas heater unit 2 and the electric heater unit 3 from each other. Thus, even if the cross-sectional area of the second inlet 13*b* of the electric heater unit 3 is increased, the height of the heater itself will not increase.

Further, hot air, when blown out from the second outlet 12*b* of the electric heater unit 3, may overheat the floor of the room. Therefore, the fan duct 301*a* of the second air-blowing fan 30 is inclined upward.

What is claimed is:

1. A hybrid hot air heater comprising a chassis having first and second outlets on its front face and first and second inlets on its rear face in a configuration wherein a gas heater unit, comprised of a gas burner and a first air-blowing fan arranged below said gas burner that mixes combustion gas sent from said gas burner and air taken into said chassis through said first inlet and blows it out through said first outlet to said room, is incorporated into said chassis at its upper part, and an electric heater unit comprised of an electric heater that heats air taken in through said second inlet and a second air-blowing fan blows out said heated air through said second outlet to the room is incorporated into said chassis at its lower part in such a manner that the air-blowing systems of the respective heater units may be independent of each other, wherein said second inlet is formed in such a manner to conserve space and serves as an air inlet passage on the rear side of a housing of said first air-blowing fan that separates these heater units from each other.

2. The hybrid hot air heater according to claim 1, wherein said first and second outlets are formed adjacent to each other vertically such that air blown out by said first air-blowing fan and that blown out by said second air-blowing fan may flow into each other.

3. The hybrid hot heater according to claim 1 or 2, wherein a fan duct leading to said second outlet formed in a housing of said second air-blowing fan is inclined upward.

* * * * *